United States Patent [19]

Revermann et al.

[11] 4,201,387

[45] May 6, 1980

[54] BALLOON BUSTER GAME

[76] Inventors: Mike Revermann, c/o George Spector, 3615 Woolworth Bldg., 233 Broadway; George Spector, 3615 Woolworth Bldg., 233 Broadway, both of, New York, N.Y. 10007

[21] Appl. No.: 934,838

[22] Filed: Aug. 18, 1978

[51] Int. Cl.[2] ..... A63F 3/00; A63F 9/00

[52] U.S. Cl. ..... 273/243; 46/88; 273/138 R

[58] Field of Search ..... 273/138 R, 126 R, 119 B, 273/1 R, 243, 129 F; 46/88

[56] References Cited

U.S. PATENT DOCUMENTS

| | | | |
|---|---|---|---|
| 2,648,288 | 8/1953 | Marks | 46/88 |
| 3,357,128 | 12/1967 | Geiser | 46/88 |
| 3,608,903 | 9/1971 | Cooper et al. | 273/287 X |
| 3,795,400 | 3/1974 | Glass et al. | 46/88 X |

OTHER PUBLICATIONS

*Playthings Magazine*, Jul., 1964, vol. 62, #7, p. 122.

*Primary Examiner*—Richard C. Pinkham
*Assistant Examiner*—Scott L. Brown

[57] ABSTRACT

A game device that includes a gameboard on which playing pieces travel along a path from a start to a goal, and the game device also includes a screw turned, balloon-bursting press for determining a distance of travel of the playing pieces on the gameboard path, the device in one design including an additional pair of dice, while the device in another design includes a button pushed along a calibrated scale by a force of air from the balloon burst.

4 Claims, 5 Drawing Figures

BALLOON BUSTER GAME

This invention relates generally to games.

A principal object of the present invention is to provide a game device in which a controlled bursting of a balloon is utilized to determine a distance of travel of a playing piece upon a gameboard toward a goal.

Another object is to provide a game device in which to controlled balloon bursting is attained by use of a press in which an inflated balloon is squeezed by a screw crank until the balloon breaks.

Another object is to provide a game device which in another design includes an air blast from the bursting balloon pushing a button along a numerically calibrated scale so to determine a distance for advance of a playing piece.

Figure 1:
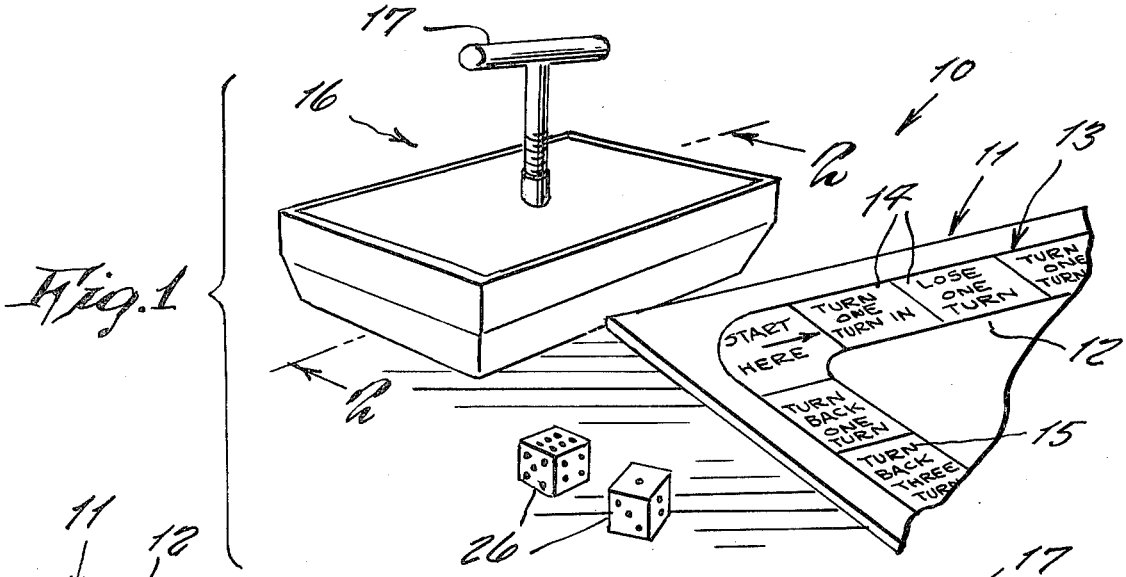
FIG. 1 is a view showing the invention components.
Figure 3:
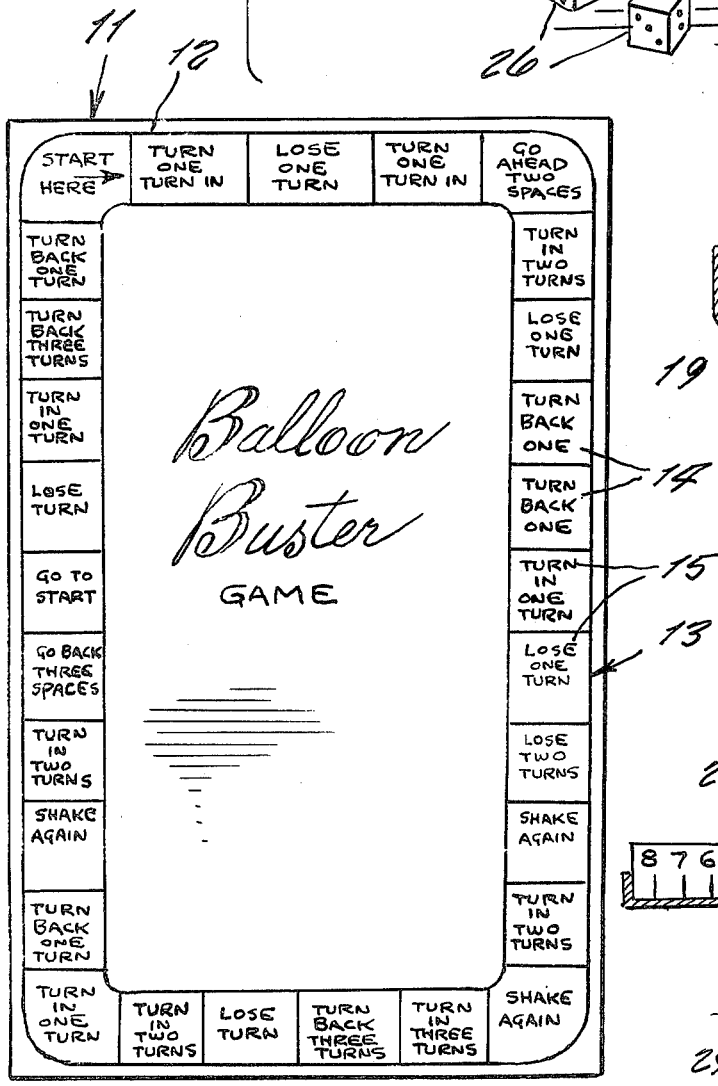
FIG. 3 is a top view of the game board.
Figure 2:
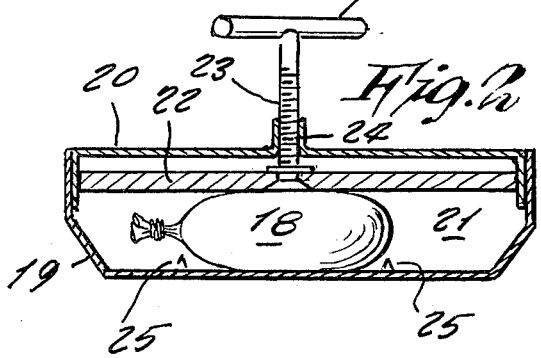
FIG. 2 is a cross section on line 2—2 of figure 1, showing the balloon buster unit.

Referring now to the drawing in greater detail, and more particularly to FIGS. 1 to 3 thereof at this time, the reference numeral 10 represents a game device according to the present invention wherein there is a gameboard 11 having a playing field 12 imprinted on one side and which includes a path 13 of spaces 14 each of which has an instruction text 15 imprinted therein for use by players of a game thereupon.

Playing pieces, not shown, are used for travel upon the path.

The game device includes a press 16 for use in determining a number of spaces travelled by a playing piece at each players turn. This is determined by a number of turns of a handle 17 made by a player before he hears a balloon 18 explode inside the press.

The press includes a tray 19 fitted by upwardly removable cover 20 so an inflated balloon 18 is placed inside a central compartment 21 underneath a downwardly slidable plate 22 pivotally held at a lower end of a screw-threaded shank 23 of the handle, and which engages a screw threaded opening 24 of the cover 20.

In a modified design, one or several short pointed spikes 25 inside the tray can be included so to aid puncturing and exploding the balloon as it is compressed.

The game device can also include a pair of dice 26 for use instead of the press, if so desired, in order to determine distance of travel for the playing pieces.

Figure 4:
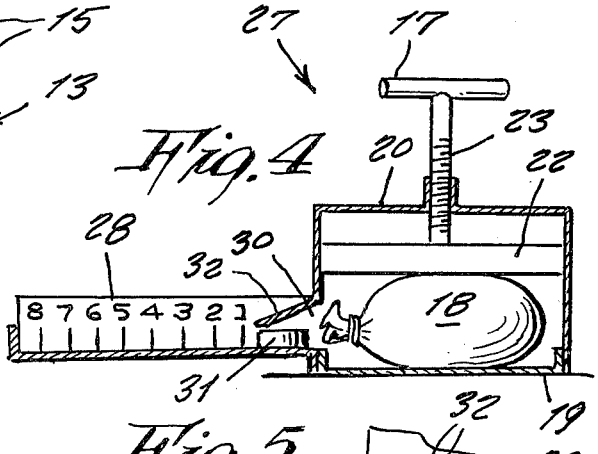
FIG. 4 is a side cross section of a modified design of balloon buster unit which automatically pushes a button (by means of the air blast) along a calibrated scale so to replace use of dice to indicate how many spaces a playing piece can advance.
Figure 5:
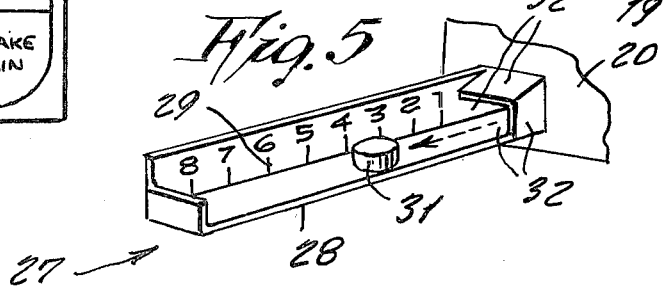
FIG. 5 is a detail of the structure shown in FIG. 4.

In a further modified design shown in FIGS. 4 and 5, the game device includes a different balloon press 27, instead of press 16, the press 27 including all of the above described elements of press 16 but also including a sideward chute 28 formed on the cover 20 which includes a numerically calibrated scale 29 along its length. An opening 30 is made in the cover side wall so that a button 31 can be seated within the opening in order that compressed air force from a bursting balloon with thrust the button outward of the opening 30 and along the chute in order to determine a playing piece travel distance. The opening is made tubular by means of flanges 32, so that the compressed air in the tubular portion thereof will be effective to move the button, the button being a snug fit within the opening. Thus in this design, the number of turns made by the handle 17 are not counted.

What is claimed is:

1. A game device, comprising in combination, a gameboard, a plurality of playing pieces movable upon said gameboard, and a balloon squeezing press for determining a travel distance of said playing pieces on said gameboard, said press including an enclosure having a central compartment, an inflated balloon inside said compartment, an opening in a side of said enclosure, a button placed in said opening, a sidewardly chute on an outer side of said enclosure for said button to slide thereupon and said chute being numerically calibrated.

2. The combination as set forth in claim 1, wherein said opening is tubular by including extending flanges therearound.

3. The combination as set forth in claim 1, wherein said enclosure is comprised of a bottom tray, a removable cover over said tray, a slidable plate inside said compartment pivotably secured to a lower end of a shank screw engaged in a threaded opening through said cover, and an upper end of said shank has a cross handle.

4. The combination as set forth in claim 3, wherein short pointed spikes are on an inner side of said enclosure.

* * * * *